US006439250B1

(12) United States Patent
Balan

(10) Patent No.: US 6,439,250 B1
(45) Date of Patent: Aug. 27, 2002

(54) SAFETY SUPPORT DEVICE AND METHOD

(76) Inventor: Ruben Balan, 3701 S. El Camino Real, San Clemente, CA (US) 92672

( * ) Notice: Subject to any disclaimer, the term of this patent is extended or adjusted under 35 U.S.C. 154(b) by 0 days.

(21) Appl. No.: 09/510,421

(22) Filed: Feb. 22, 2000

Related U.S. Application Data

(60) Provisional application No. 60/121,252, filed on Feb. 23, 1999.

(51) Int. Cl.[7] ..... A61H 3/02

(52) U.S. Cl. ..... 135/67; 135/66; 482/69; 280/82.091

(58) Field of Search ..... 134/67, 85, 82, 134/71, 72, 73; 280/87.04, 87.01; 16/24, 25, 44

(56) References Cited

U.S. PATENT DOCUMENTS 4,993,446 A * 2/1991 Yarborough ..... 135/67
5,819,772 A * 10/1998 Pi ..... 135/66
6,059,697 A * 5/2000 Breems ..... 482/67
6,170,840 B1 * 1/2001 Mathias ..... 280/87.041

* cited by examiner

*Primary Examiner*—Carl D. Friedman
*Assistant Examiner*—Steven M Varner
(74) *Attorney, Agent, or Firm*—John J. Connors; Connors & Associates, Inc.

(57) ABSTRACT

The safety support device of this invention includes a frame having a mounting section with a forward end and a rear end. A pair of forward legs are attached to the forward end of the mounting section and a pair of rear legs are attached to the rear end of the mounting section. Each leg has a distal end to which is attached a roller assembly. Each roller assembly includes a roller member mounted so that with the weight of the user bearing down on the assembly the roller member is prevented from moving. In a second embodiment used to assist injured or elderly person stand erect, the legs are long and arm support members engage the arm pits of the user when the user is being supported by the device.

1 Claim, 14 Drawing Sheets

64
90
82b
82a
90
82a
8A
72b
72a
104
7
8
105
7
8
100
102
100c
100b
60
78
70b
100
78
70a
78a
78b
78
76
78
76
80
76
76
80
80
9
80

10
10
90
90
64
66
68
74a
74b
72a
72b
70b
70a
105
60
104
100c
80
80

64
82b
82a
154
154
60
150
152
156
156
72a
72b
80
80
80

FIG. 7
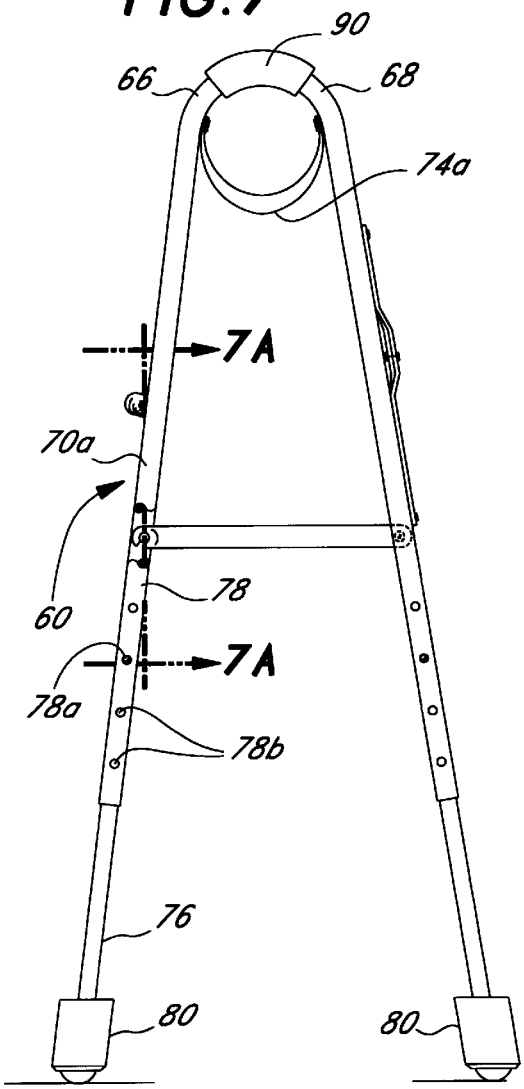
FIG. 8
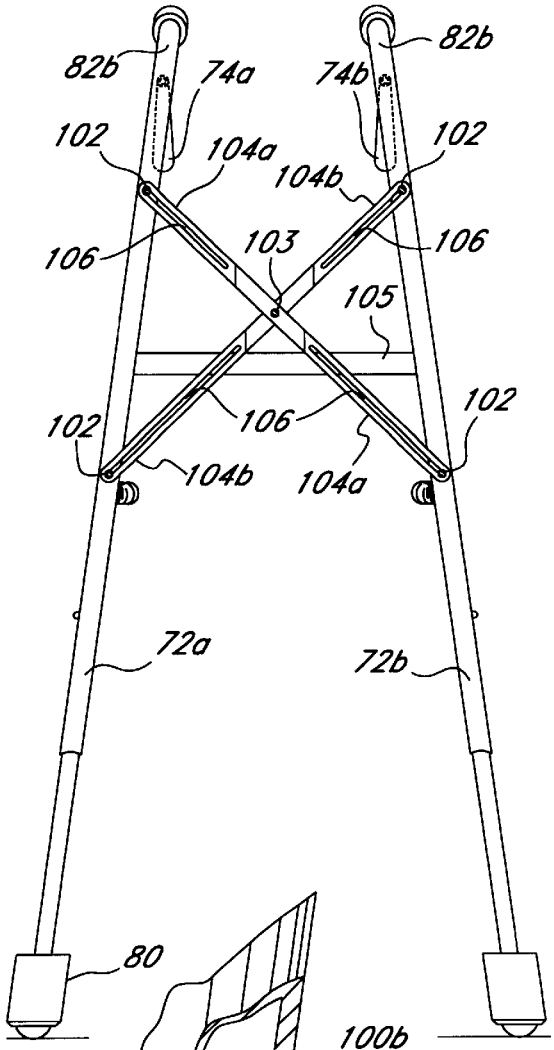
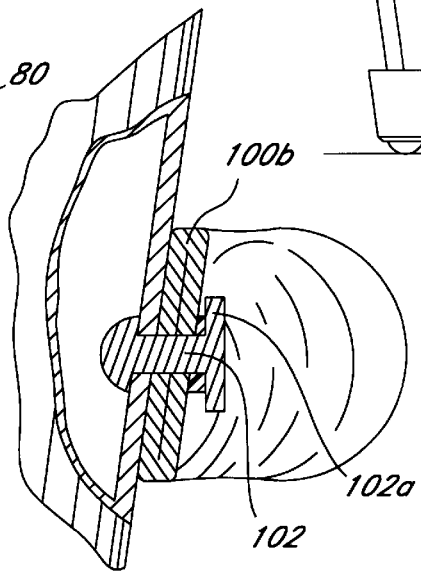
FIG. 7A

SAFETY SUPPORT DEVICE AND METHOD

RELATED APPLICATION

This application is a utility patent application based on U.S. provisional patent application Ser. No. 60/121,252, filed Feb. 23, 1999, entitled Skater Safety & Training Device & Method, which is incorporated herein by reference and made a part of this application.

BACKGROUND OF THE INVENTION

There are many situations where an individual needs assistance standing erect. For example, roller skaters who are just leaning to skate, and injured or elderly people who need support when they walk.

In-line roller skates have become very popular, but they are much more difficult for novice skaters to master without falling frequently. Although helmets, knee pads, elbow pads and other safety accessories are used, they don't inhibit the skater from falling, but only provide protection if the skater falls. It would be very desirable for a novice skater to have some device which would prevent him or her from falling. Although such a device is especially useful for in-line roller skaters, those using conventional skates with two pairs of wheels straddling the center line of the skate could also benefit from such a device.

Injured and elderly people sometimes use walkers that are held in front of the user and moved forward in a stepwise manner as the person walks. These walkers usually have four support legs and a handle bar at about waist level of the user. They do not, however, support the entire weight of the user. Sometimes crutches are employed which are placed under the arm pits of the user and manipulated as the user walks. Each individual crutch only has one point of contact with the supporting floor. Crutches support the entire weight of the user, but they are sometimes difficult for some individuals to use. Consequently, it would be desirable to provide a safety support device that has the advantage of ease of use of a walker and also supports the entire weight of the user like a pair of crutches.

SUMMARY OF THE INVENTION

This invention has several features, no single one of which is solely responsible for its desirable attributes. Without limiting the scope of this invention as expressed by the claims that follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to, improved safety for the user, compactness, portability, ease of manufacture, and versatility.

The first feature of the safety support device of this invention is that it supports a user's body above ground while using the device. In a first embodiment, the device supports a user while seated, and in a second embodiment, the device supports the user in a standing erect position. The first embodiment is particularly suited for use by skaters. The second embodiment is used by injured and elderly individuals who need support while walking. Both embodiments have a frame including a mounting section from which four legs extend, a pair of forward legs and a pair of rear legs. Each embodiment has a roller assembly attached to a distal end of a leg. These roller assemblies each include a roller member mounted so that with the weight of the user bearing down on the assembly the roller member is prevented from moving. The roller member may be either a wheel or a ball.

The second feature is that the roller assembly may (1) move between an extended position when a user is using the device and not being supported by the device and a retracted position when a user is being supported by the device, or (2) includes a cover mounted to move along a shaft. The shaft has the roller member rotatably mounted to a distal end of the shaft with a proximal end of the shaft extending outward from the cover. The cover has an intermediate portion attached to a distal end of a leg, and the cover is mounted to slide along the shaft as the roller member moves between the extended and retracted positions. A spring interacts with the cover to normally urge the roller member and the cover away from each other so that the roller member is normally in the extended position.

The third feature is the unique construction of the frame of the first embodiment, the safety and training device. This frame preferably is made of metal tubes welded or otherwise attached together. It comprises a pair of attached tubular members, each tubular member being bent in essentially an identical fashion in a curved, substantially M-shaped configuration. Portions of the tubular members form the forward legs and rear legs. These legs preferably outwardly diverge and have a length of from about 28 to about 36 inches and are arranged so that the mounting section is substantially parallel to ground. The mounting section is from about 28 to about 36 inches above ground. In this first embodiment, the length of the mounting section is from about 12 to about 18 inches, and it has a central, depressed segment across which the seat extends. Also, there is a handle member, preferably in the form of a loop, mounted to the forward end of the mounting section in advance of the seat.

The forth feature is the unique construction of the frame of the second embodiment, the walker support device. In this second embodiment, the mounting section includes a pair of under arm support members attached to the mounting section. Each arm support member engages an arm pit of the user when the user is being supported by the device, and the legs are of a length that enables the user to assume a standing position with the support members beneath the arm pits of the user's arms and user's feet touching the ground. The legs have an adjustable length of from about 48 to about 72 inches to accommodate the height of the user. There are hand grips extending between adjacent forward and rear legs, and the mounting section includes a pair of sleeve members, with adjacent proximal ends of the forward and rear legs extending into an individual sleeve member. The under arm support members are flexible, the hand grips are mounted to be repositioned, and legs are foldable inward to provide a compact structure. Preferably, this second embodiment includes a harness.

This invention also includes of supporting a user's body above ground, for example, when skating or walking. It comprises (a) providing a device including a frame having a mounting section with a forward end and a rear end, a pair of forward legs attached to the forward end of the mounting section and a pair of rear legs attached to the rear end of the mounting section, each leg having a distal end to which is attached a roller assembly, with each roller assembly including a roller member mounted to move between an extended position when a user is using the device and not being supported by the device and a retracted position when a user is being supported by the device, (b) positioning the user's body relative to the device so that the device will support the user's body when the user falls towards the ground.

DESCRIPTION OF THE DRAWING

The preferred embodiments of this invention, illustrating all its features, will now be discussed in detail. These embodiments depict the novel and non-obvious safety support devices and method of this invention as shown in the accompanying drawing, which is for illustrative purposes only. This drawing includes the following figures (FIGS.), with like numerals indicating like parts:

FIGS. 1 through 5 illustrate the first embodiment of this invention wherein:

FIG. 1 is a perspective view of the skater safety and training device of this invention.

FIG. 2 is a fragmentary perspective view of the skater safety and training device of this invention, looking from the user's point of view when mounted on the device.

FIG. 4 is a side view of the skater safety and training device of this invention showing a user using the device while skating.

FIG. 5 is a side view similar to that of FIG. 4 showing how the device prevents a user from falling, with the wheels in the retracted position and the device supporting the user in a seated position.

FIGS. 6 through 14 illustrate the second embodiment of this invention wherein.

FIG. 6 is a perspective view of the walker support device of this invention in an unfolded state.

FIG. 6C is a perspective view of the harness attached to the walker support device depicted in FIG. 6 and shown phantom lines.

FIG. 7 is a side elevational view of the walker support device shown in FIG. 6 taken along line 7—7.

FIG. 7A is a cross-sectional view taken along line 7A—7A of FIG. 7.

FIG. 8 is a rear elevational view of the walker support device shown in FIG. 6 taken along line 8—8.

FIG. 9 is an enlarged, fragmentary, exploded perspective view of the roller assembly taken along line 9 of FIG. 6, showing a ball employing a brake.

FIG. 10 is a plan view taken along line 10–10 of FIG. 6 depicting the user moving to straight ahead.

FIG. 11 is a plan view similar to that shown in FIG. 10 depicting the user moving to the left as shown in this view.

FIG. 12 is a plan view similar to that shown in FIG. 10 depicting the user moving to the right as shown in this view.

FIG. 13 is a plan view similar to that shown in FIG. 10 depicting the user moving to the rear.

FIG. 14 is a side view of the device illustrated in FIG. 6 showing the front brace and side hand grips folded up and the distal ends of the legs pushed into the interior of the upper legs.

DETAILED DESCRIPTION OF THE PREFERRED EMBODIMENTS

Skater Safety Training Device

Figure 1:
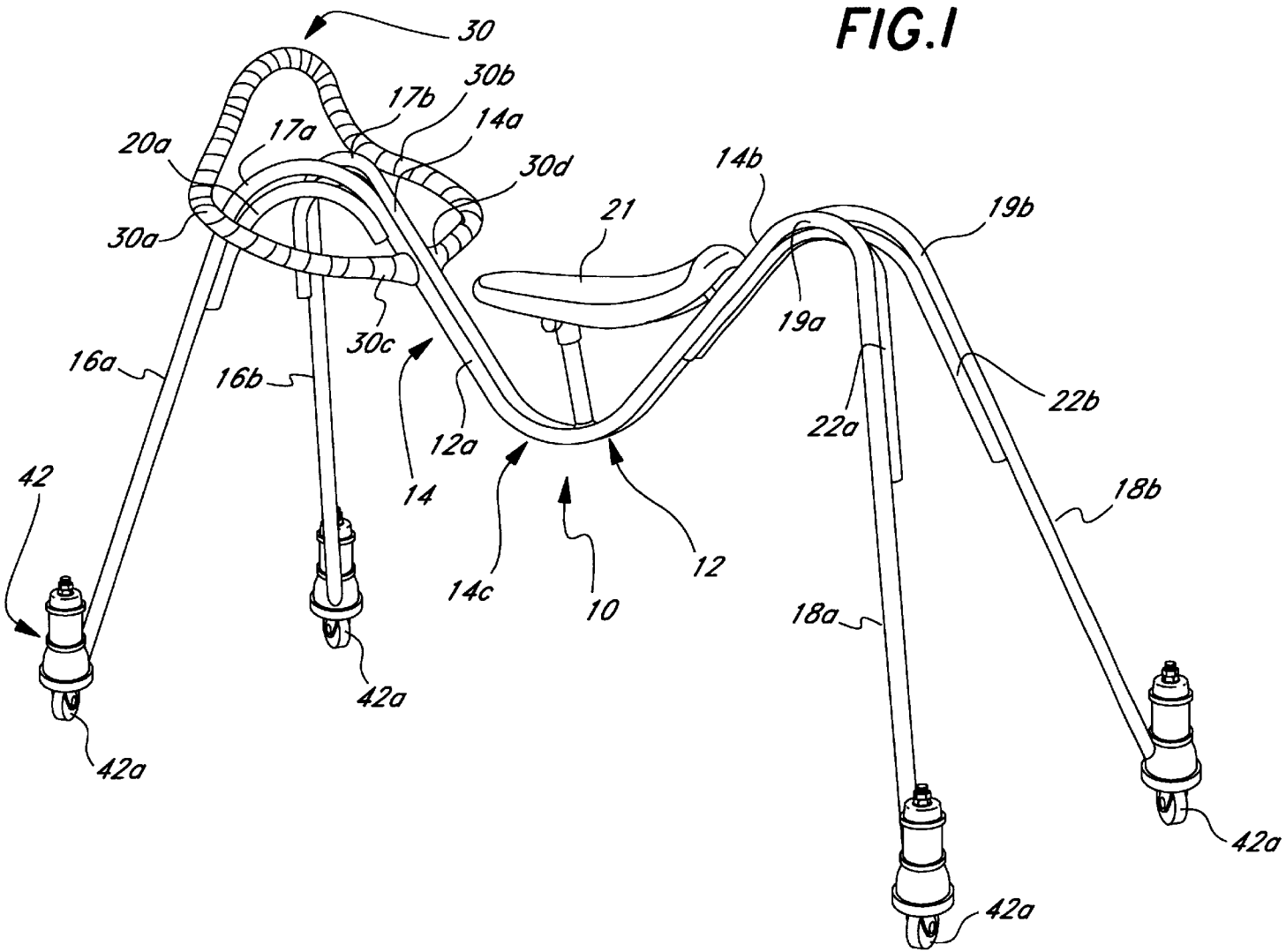
Figure 4:
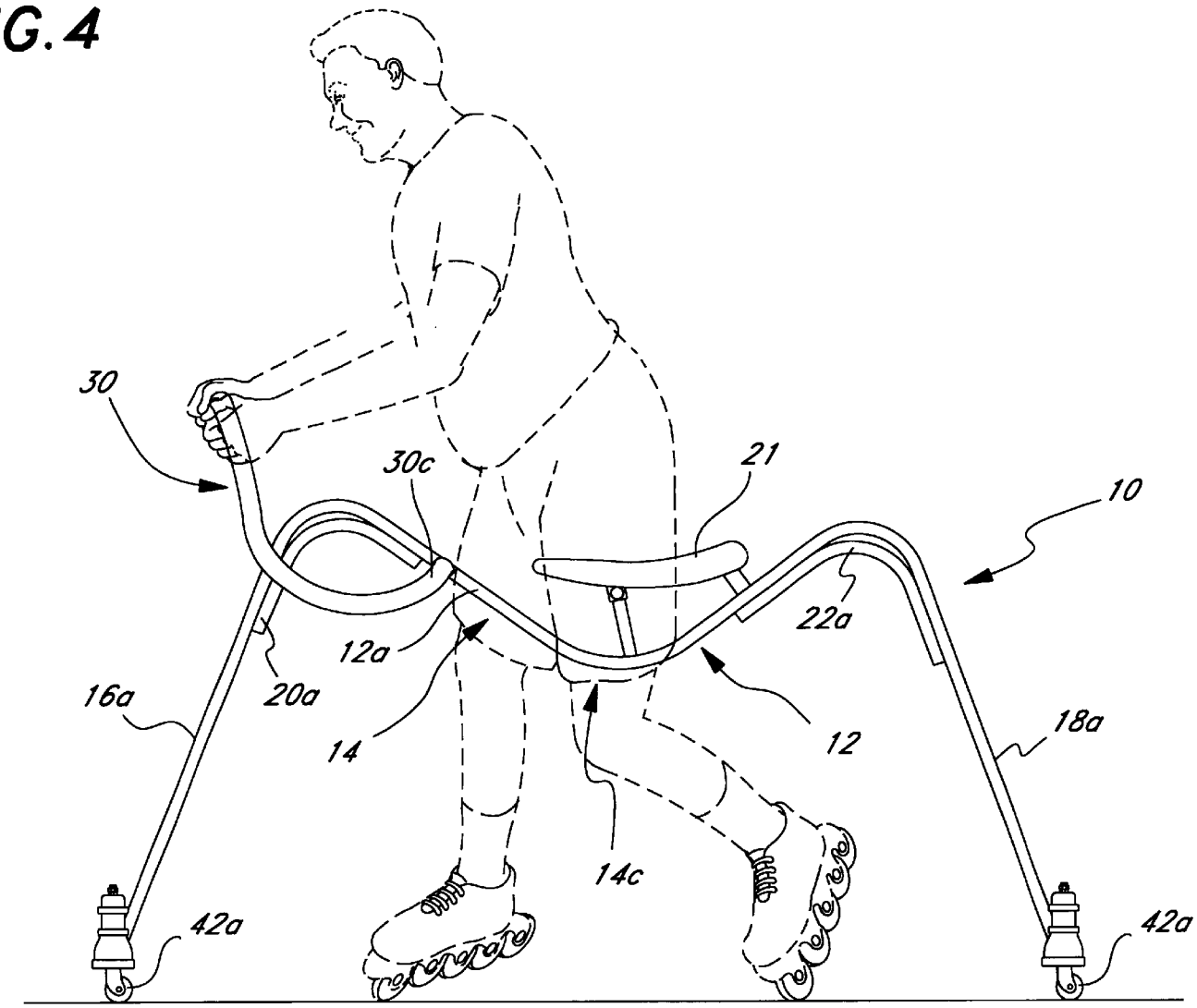
Figure 5:
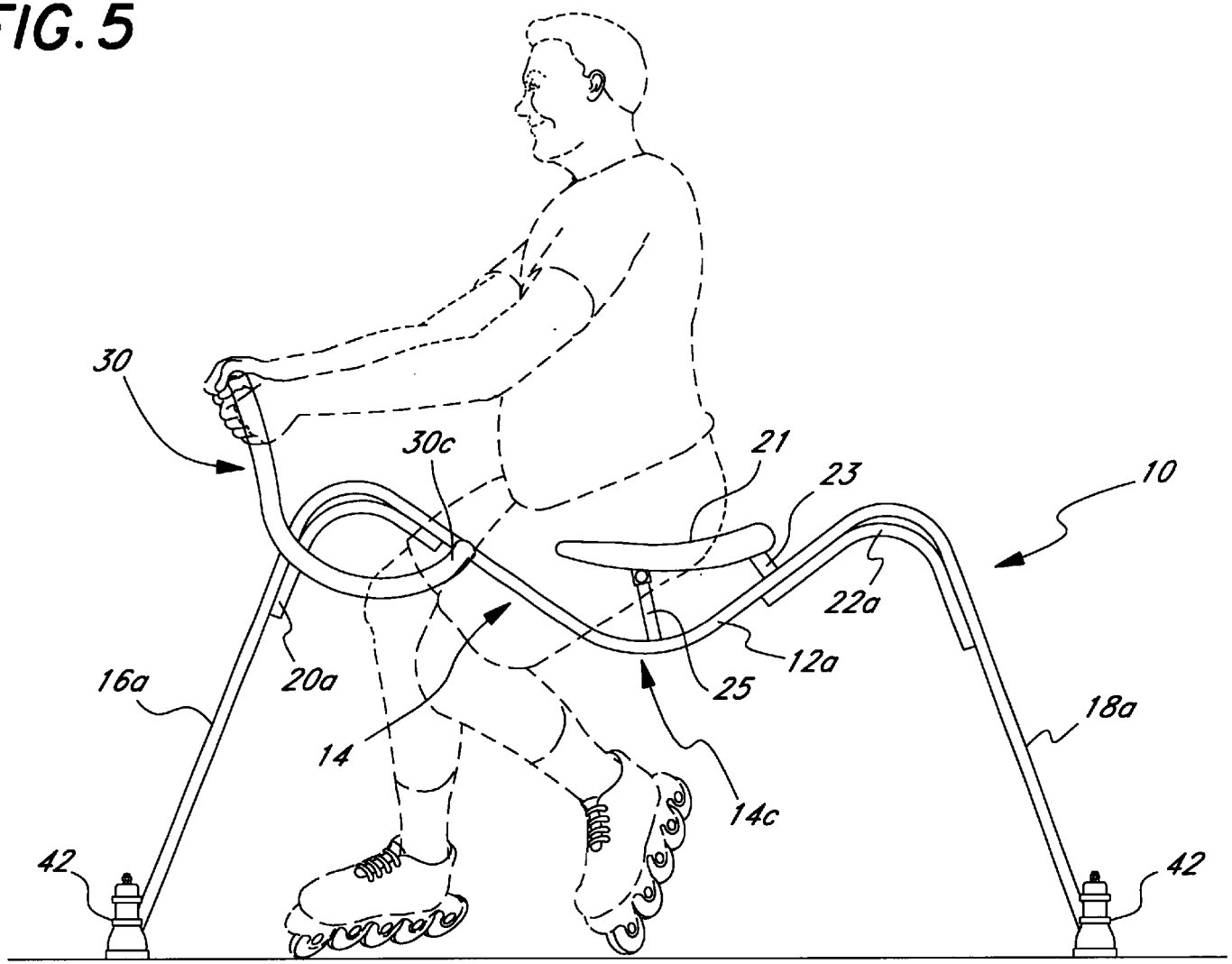

As best shown in FIG. 1, the skater safety and training device 10 of this invention is used by a skater (shown in phantom) who straddles the device while skating, as shown in FIG. 4. The device 10 includes a frame 12 adapted to catch the skater when he or she falls and support the skater in a seated position as shown in FIG. 5.

The frame 12 is made of a metal such as steel or aluminum, preferably of a tubular construction. It comprises a pair of metal tubes 12*a* and 12*b*, each bent in essentially an identical fashion in a curved, substantially M-shaped configuration. The tubes 12*a* and 12*b* are placed in registration and welded or otherwise fixedly connected to each other to form a mounting section 14 having a forward end 14*a* and a rear end 14*b*. The outside diameter of the tubes 12*a* and 12*b* making up the frame 12 is from about 1 to about 1.25 inch. The length of the mounting section 14 is from about 12 to about 18 inches. A central, depressed segment 14*c* of the mounting section 14 has a seat 21 extending across this segment. A pair of tubular supports 23 and 25 extend upward from the mounting section 14 and are connected to the underside of the seat 21. The seat 21 is slightly lower than the forward end 14*a* and rear end 14*b* of the mounting section 14.

A pair of outwardly diverging, forward legs 16*a* and 16*b* extend from the forward end 14*a* downward toward the ground and a pair of outwardly diverging, rear legs 18*a* and 18*b* extend from the rear end 14*b* downward toward the ground. Each pair of legs 16*a*, 16*b* and 18*a*, 18*b* form an inverted V-shaped configuration and are integral, respectively, with the tubes 12*a* and 12*b*. Each leg 16*a*, 16*b* and 18*a*, 18*b* is about the same length, typically having a length of from about 28 to about 36 inches. A pair of reinforcing arcuate members 20*a* and 20*b* are connected across upper portions 17*a* and 17*b*, respectively, of each forward leg 16*a* and 16*b* and the forward end 14*a* of the mounting section 14 to the tubes 12*a* and 12*b*, respectively. Another pair of reinforcing arcuate members 22*a* and 22*b* are connected across upper portions 19*a* and 19*b*, respectively, of each rear leg 18*a* and 18*b* and the rear end 14*b* of the mounting section 14 to the tubes 12*a* and 12*b*, respectively. The upper portions 17*a*, 17*b*, 19*a* and 19*b* form the proximal ends of the legs 16*a*, 16*b*, 18*a*, 18*b*, respectively, and are above the central segment 14*c* of the mounting section 14.

Figure 2:
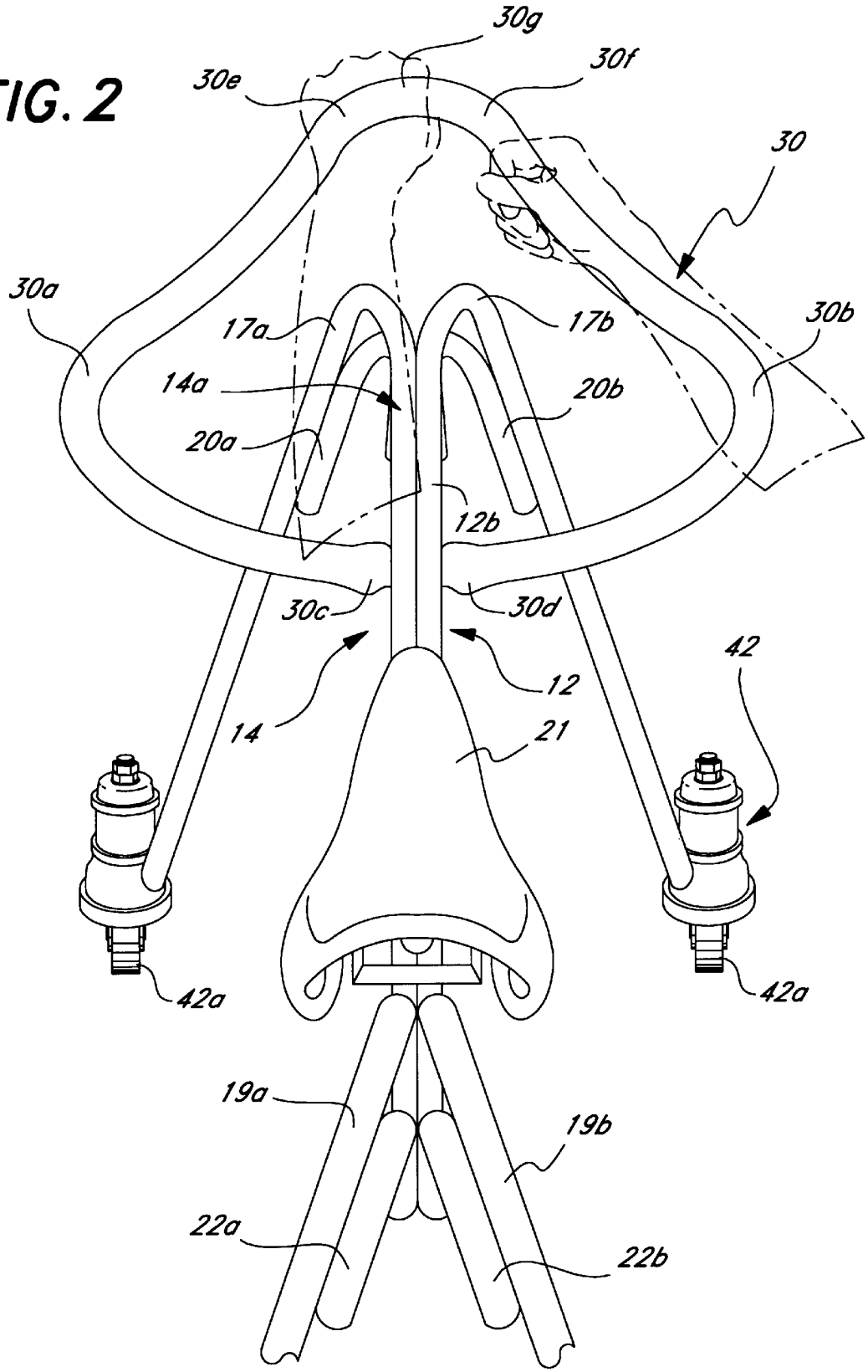

As best shown in FIG. 2, there is a handle member 30 in the form of a loop attached to the forward end 14*a* of the mounting section 14. The looped handle 30 has a substantially triangular configuration with opposed sides 30*a* and 30*b*, each having rear ends 30*c* and 30*d*, respectively, welded or otherwise fixedly connected to the tubes 12*a* and 12*b*. The forward ends 30*e* and 30*f* of the handle 30 join to form the apex 30*g* of the triangular shaped looped handle 30. These forward ends 30*e* and 30*f* form a forward section which is tilted upward and the rear ends 30*c* and 30*d* form a rear section which is tilted downward. The skater may conveniently grasp either the forward or rear sections of the handle while skating. In FIG. 4, the skater is shown grasping the forward, upwardly titled section of the handle 30.

Figure 3A:
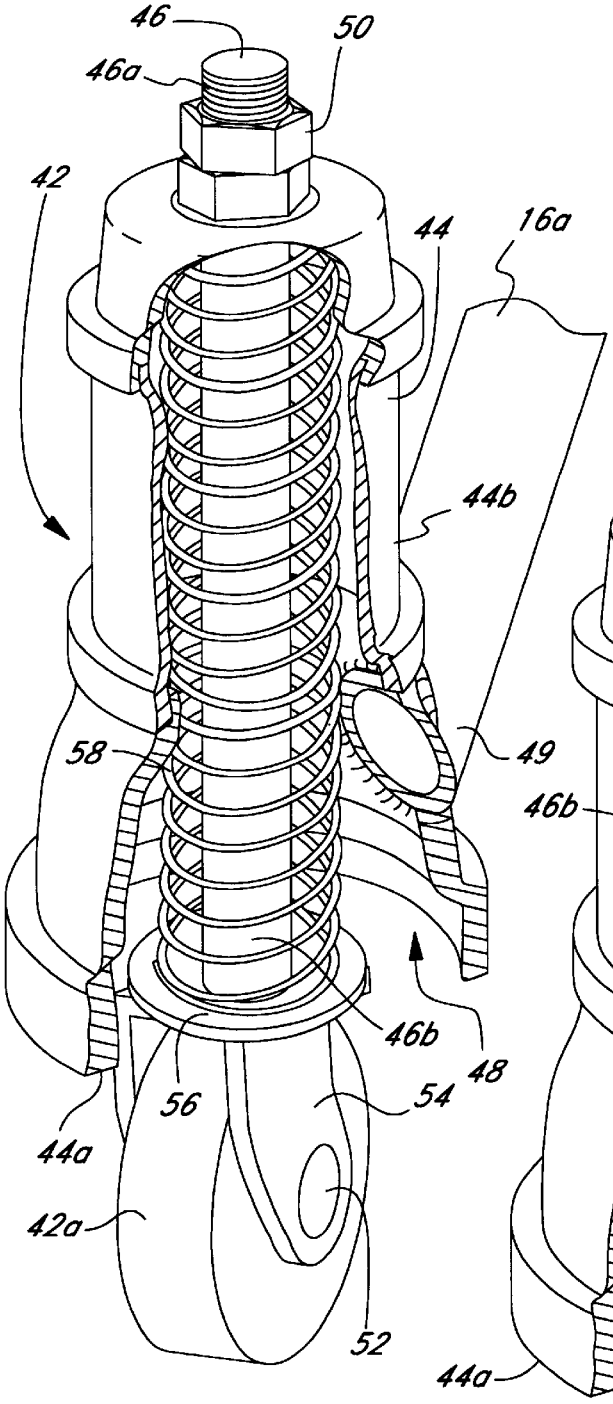
FIG. 3A is a fragmentary perspective view of one of the wheels and cover therefor with the wheel in the extended position.
Figure 3B:
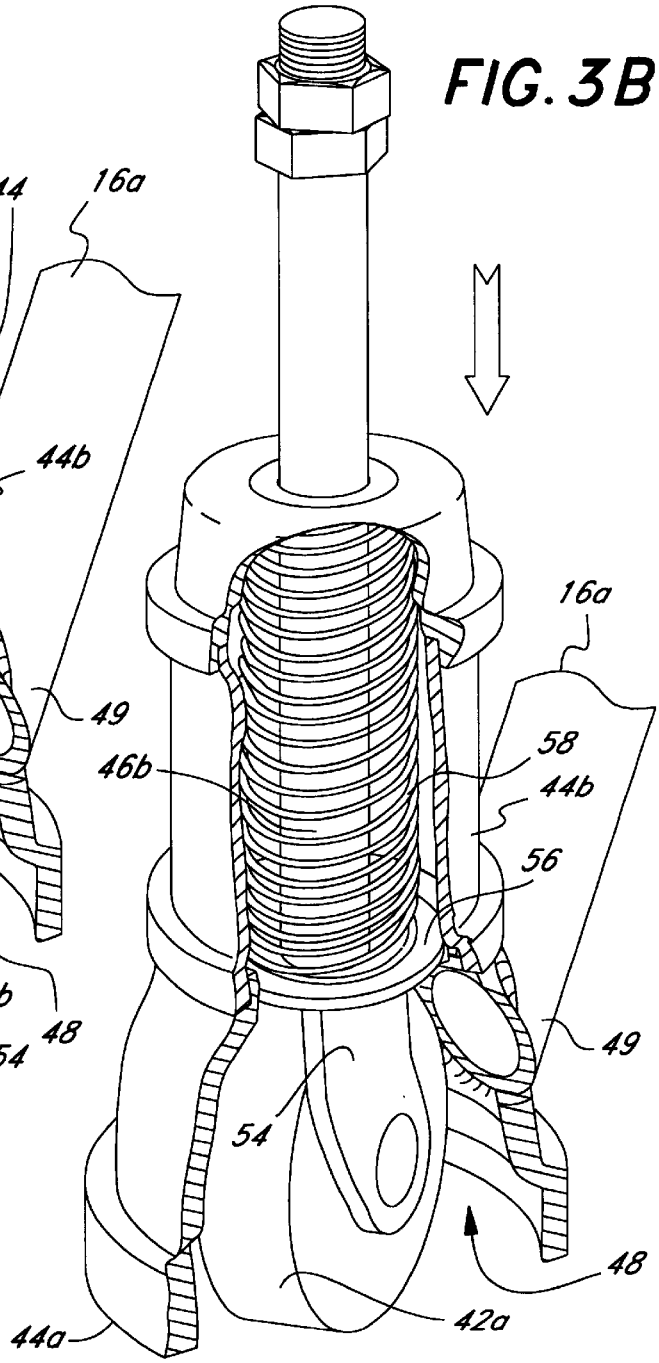
FIG. 3B is a fragmentary perspective view similar to that of FIG. 3A showing one of the wheels and cover therefor with the wheel in the retracted position.

As best shown in FIGS. 3A and 3B, each leg 16*a*, 16*b*, 18*a*, 18*b* has a distal end 49 to which is attached a wheel assembly 42. Each wheel assembly 42 includes a wheel 42*a* mounted to move between extended and retracted positions. The extended position is shown in FIGS. 3A and 4 where the skater is straddling the device 10 and skating in a normal fashion and not being supported by the seat 21. The retracted position is shown in FIGS. 3B and 5 where the skater has fallen and has been caught by the device 10 and is being supported by the seat 21.

Each wheel assembly 42 includes a cover 44 which covers each wheel 42*a* and a central, longitudinal shaft 46 extends from the top of the cover into the hollow, interior 48 of the cover and having an intermediate portion 44*b* welded or otherwise attached to the distal end 49 of a leg, in this case the leg 16*a*. This shaft 46 has a treaded outer end 46*a* with nuts 50 secured to this outer end to act as a stop to prevent the cover 44 from sliding off the end 46*a* of the shaft 46. As best shown in FIGS. 3A and 3B, each wheel 42 is rotatably mounted to an axle 52 which is carried by a yoke 54 that has a land 56 at its upper portion. The inner end 46*b* of the shaft 46 is welded or otherwise secured to the land 56, and the cover 44 slides along the shaft as the wheel 42*a* moves between the extended and retracted positions. A strong, coiled spring 58 wrapped around the shaft 46, having one end bearing against the land 56 and its opposite end bearing against the inside top of the cover 44, normally urges the yoke 54 outward and the cover upward, so that the wheel 42*a* is normally in the extended position. With entire the weight of the skater on the seat 21 and supported by the device 10, the cover 44 slides downward towards the ground along the shaft 46, compressing the spring 58 as shown in FIG. 3B, and the wheel 42*a* is moved into the retracted position within the cover 44 as shown in FIGS. 3B and 5. As shown as the weight of the skater is removed, the spring 58 pushes the cover 44 upward along the shaft 46, exposing the wheel 42*a*.

To use the device 10 of this invention, the skater simply straddles the device along the mounting section 14 with each leg of the skater on one side of the device and his or her crotch above but not touching the seat 21. The skater grasps the handle 30, preferably with both hands, and begins to skate in a normal fashion. As shown in FIG. 5, if the skater looses his or her balance and begins to fall, they simply sit on the seat 21 and the wheels 42*a* are retracted into the cover 44, with the bottom edge 44*a* resting on the ground. The device 10 supports the skater in this seated position and prevents him or her from falling and injuring themselves.

Walker Support Device

Figure 6:
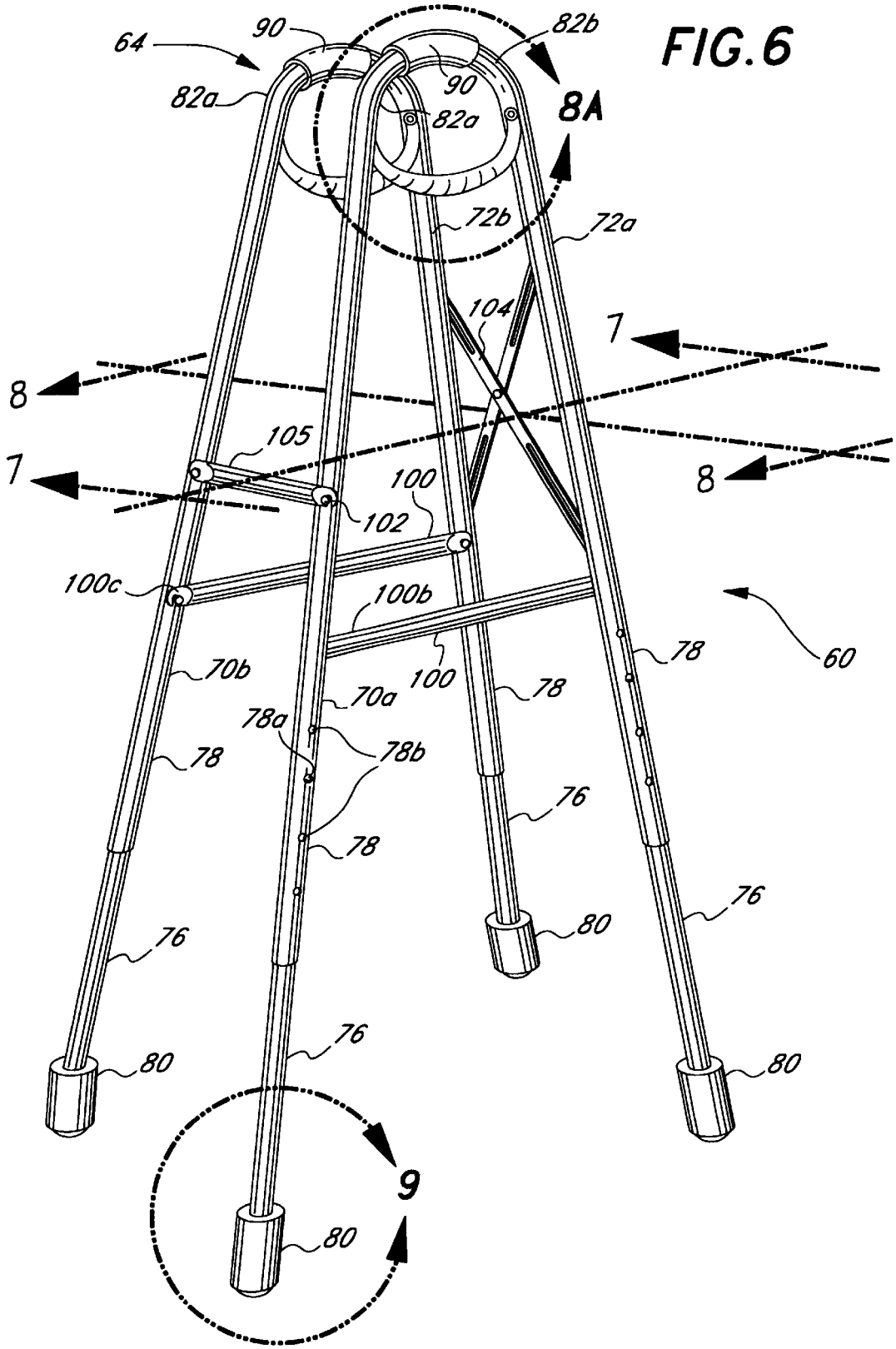
Figure 6A:
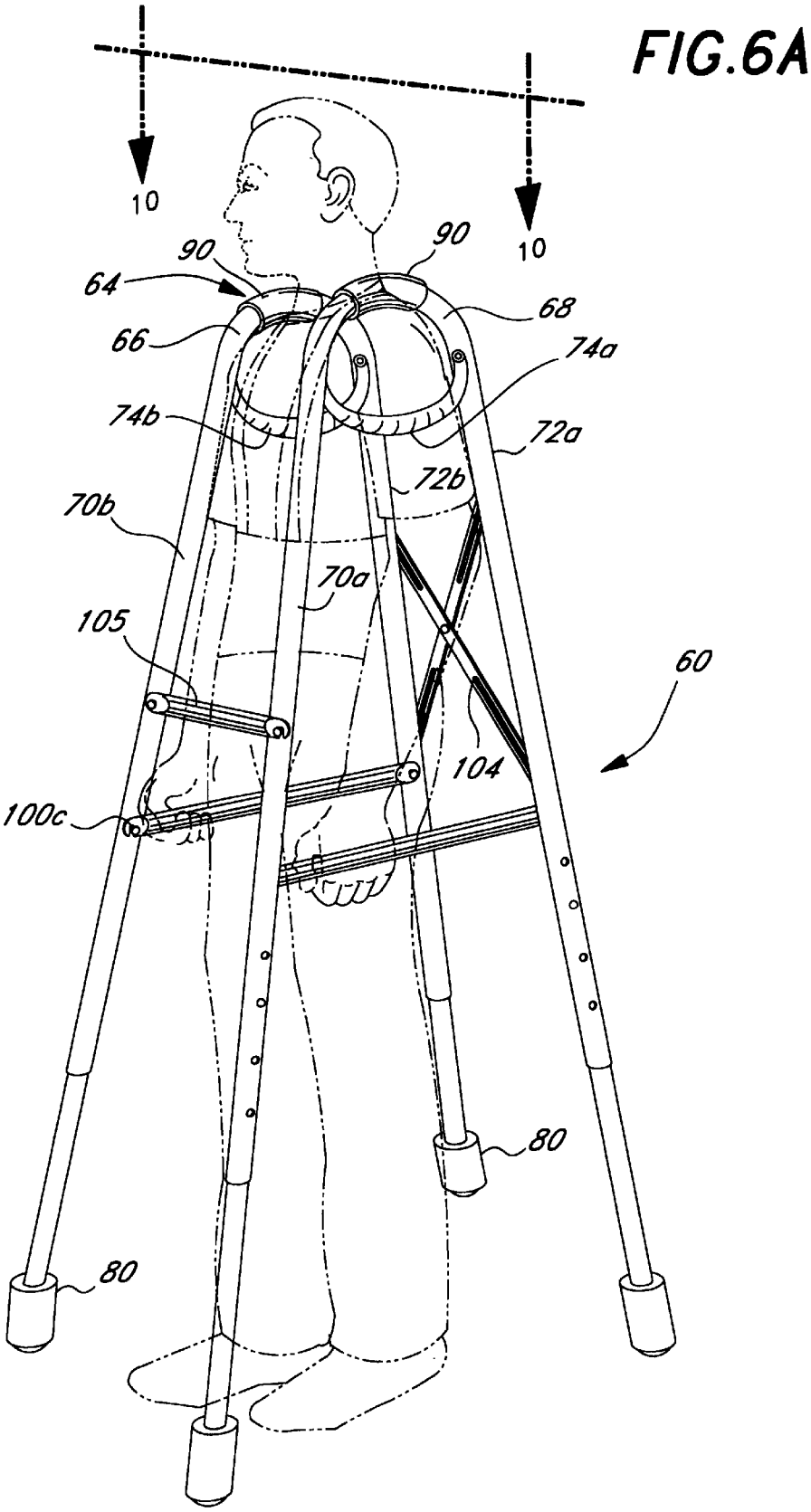
FIG. 6A is a perspective view of the walker support device depicted in FIG. 6 illustrating a user in phantom lines standing erect using the device.
Figures 8A, 8B, 8C, 8D:
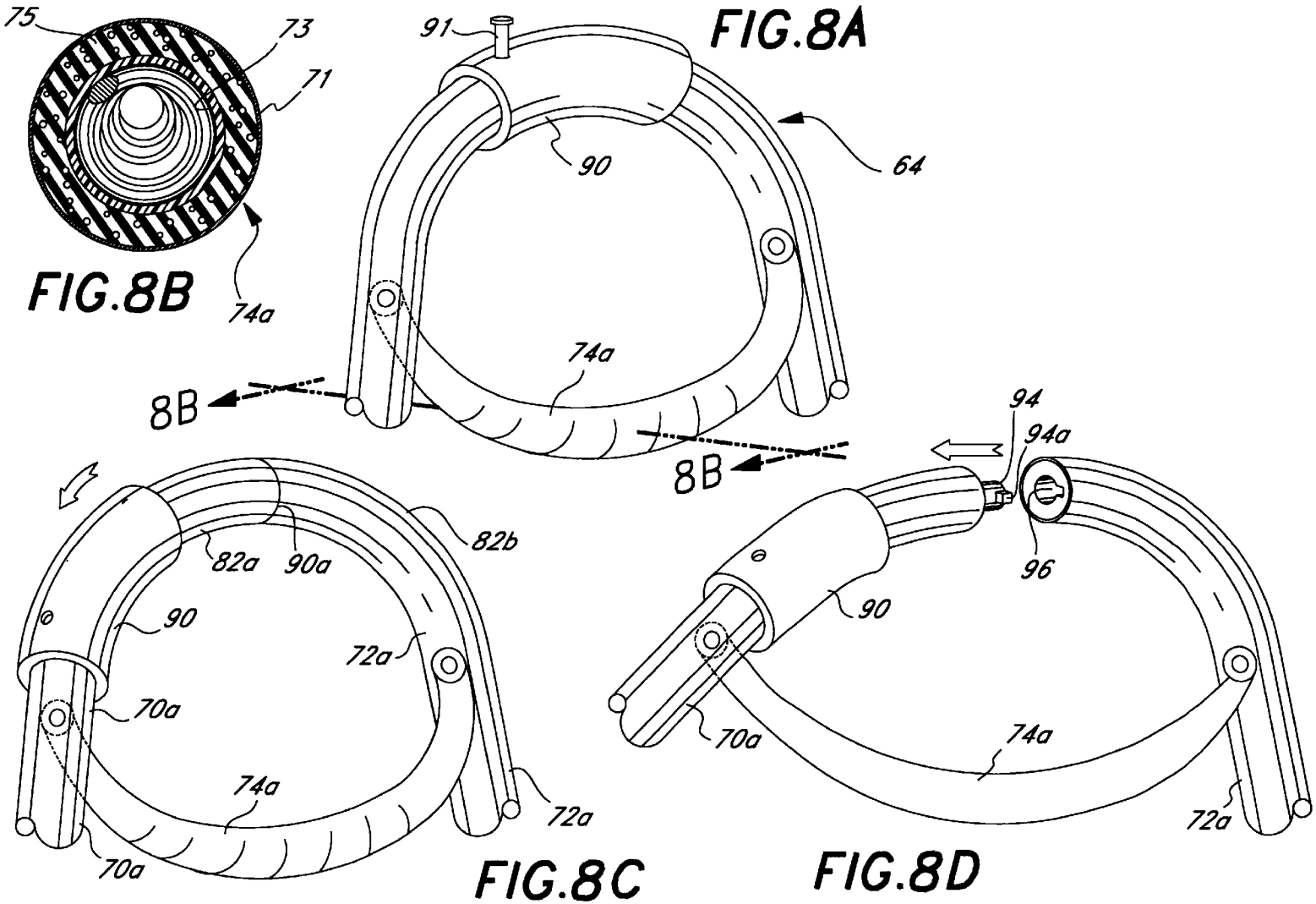
FIG. 8A is an enlarged, fragmentary perspective view of the mounting section.
FIG. 8B is a cross-sectional view taken along line 8B—8B of FIG. 8A.
FIG. 8C is an enlarged, fragmentary perspective view of the mounting section showing the sleeve moved to allow disconnection of the upper segments of a pair of front and rear legs.
FIG. 8D is an enlarged, fragmentary perspective view of the mounting section showing a pair of front and rear legs disconnected.

The second embodiment of this invention, the walker support device 60, is used to support a user's body above ground while the user is in an erect standing position as depicted in FIG. 6A. It includes a frame 62 having a mounting section 64 with a forward end 66 and a rear end 68. There are a pair of forward legs 70*a*and 70*b* integral with the forward end 66 of the mounting section 64 and a pair of rear legs 72*a* and 72*b* integral with the rear end 68 of the mounting section. A pair of flexible under arm support members 74*a* and 74*b* are attached beneath the mounting section 64. As best shown in FIG. 6A, each arm support member 74*a* and 74*b* forms a loop that engages an arm pit of the user when the user is being supported by the device 60. As shown in FIG. 8B, each of these each arm support member 74*a* and 74*b* comprises a pair of concentric tubular members 71 and 73 separated by a foam material 75.

Figure 17:
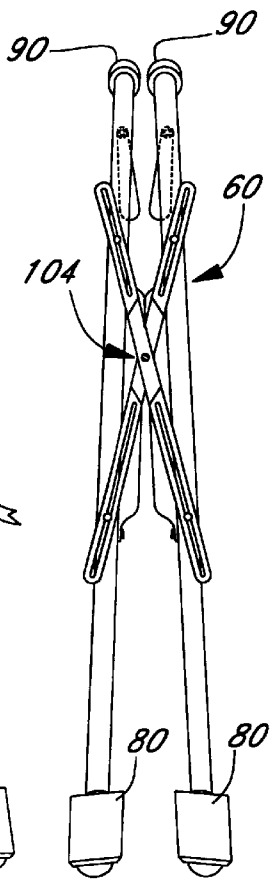
FIG. 17 shows the device illustrated in FIG. 6 in the folded state.
Figure 16:
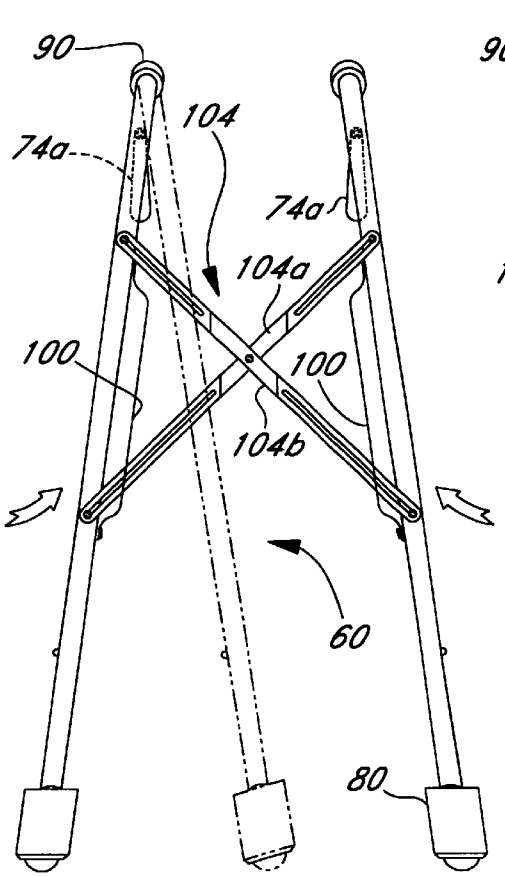
FIG. 16 is a rear view showing the cross-bars being pushed inward to bring the two pairs of legs together as depicted in FIG. 17.

There are hand grips 100 extending between adjacent pairs of forward and rear legs 70*a*, 72*a* and 70*b*, 72*b*. These hand grips 100 each have one end 100*a* pivotally connected to a rear leg 72*a* and 72*b*. As best shown in FIG. 7A, another end 100*b* with a notch 100*c* in it engages a rod 102 with a flat end 102*a* extending outward from each of the forward legs 70*a*and 70*b* when the device 60 is in the unfolded state. A front brace 105, constructed like the hand grips, extends between the front legs 70*a* and 70*b*. It has one end pivotally mounted to the leg 70*b* and its other end engaging a rod extending from the other leg 70*a*. A cross-bar 104 is attached to the rear legs 72*a* and 72*b*. As best depicted in FIG. 8, it comprises two braces 104*a* and 104*b* positioned in an X shape. These braces 104*a* and 104*b* have their centers attached to pivot pin103 and their ends mounted to side along the rear legs 72*a* and 72*b*. There is a pair of open channels 106 in each brace 104*a* and 104*b* on opposite sides of the pivot pin 103 that allow fixed rods 102 in the legs 72*a* and 72*b* to slide in these open channels upon folding the cross-bar 104 as shown in FIGS. 16 and 17.

The legs 70*a*, 70*b*, 72*a*, and 72*b* are of a length that enables the user to assume a standing position with the support members 74*a* and 74*b* beneath the arm pits of the user's arms and user's feet touching the ground. These legs 70*a*, 70*b*, 72*a*, and 72*b* are adjustable so their length accommodates the height of the user. Each leg 70*a*, 70*b*, 72*a*, and 72*b* has a distal segment 76 that slides telescopically into an upper segment 78. In the upper segment 78 there are a series of holes 78*a* and in the distal segment there is a spring loaded pin 76*a*. When the pin 76*a* is aligned with a hole, it snaps into a hole and remains there until manually depressed. With the pin 76*a* depressed, the distal segment 76 may be repositioned, for example, pushed completely into the upper segment 78 for storage when the device 60 is being moved into its folded state as shown in FIGS. 14 through 17. The length of the legs 70*a*, 70*b*, 72*a*, and 72*b* are adjusted manually by positioning the pin 76*a* in the appropriate holes 78*a* so that all the legs are of equal length.

Figure 9:
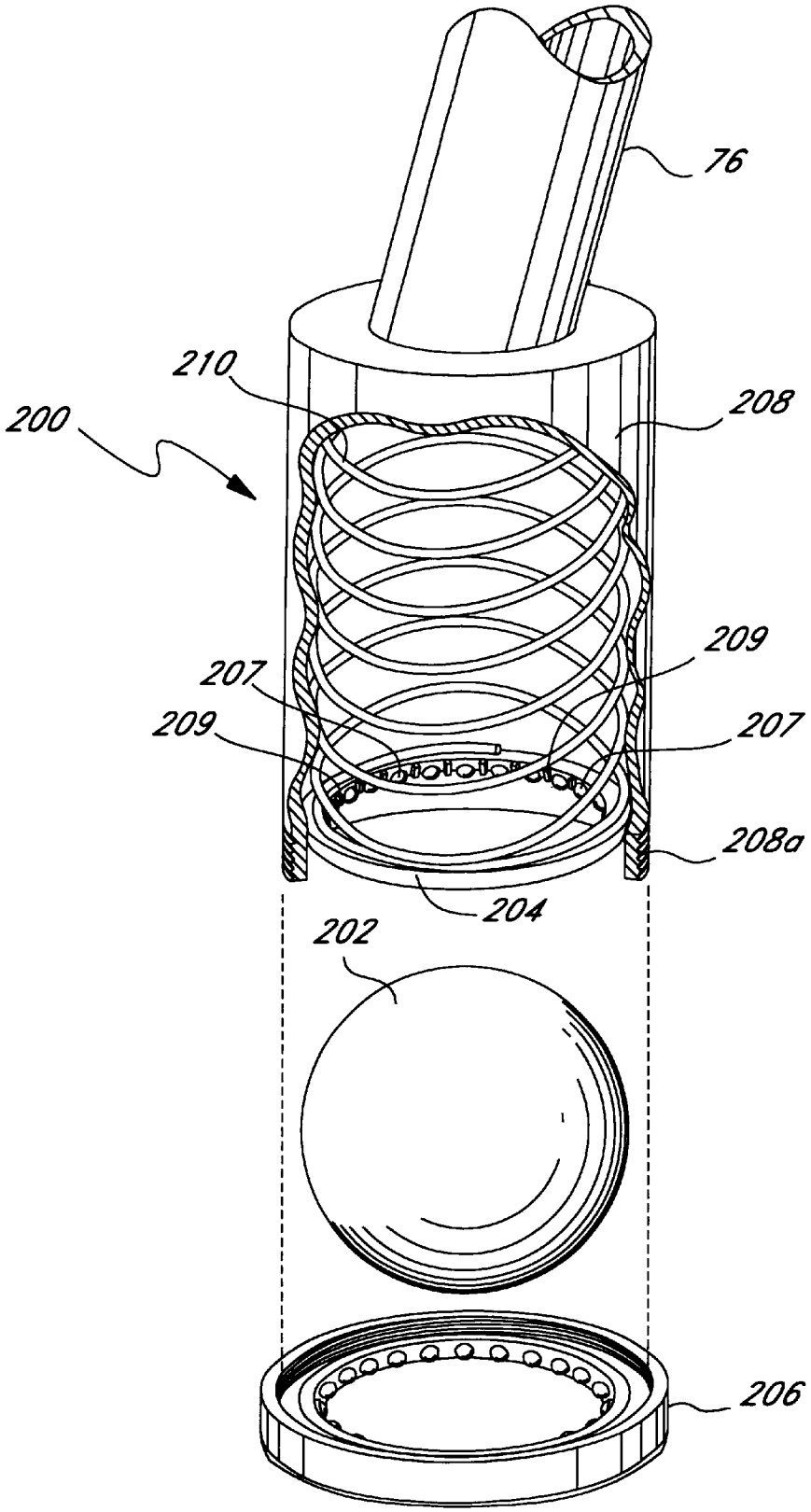
Figure 10:
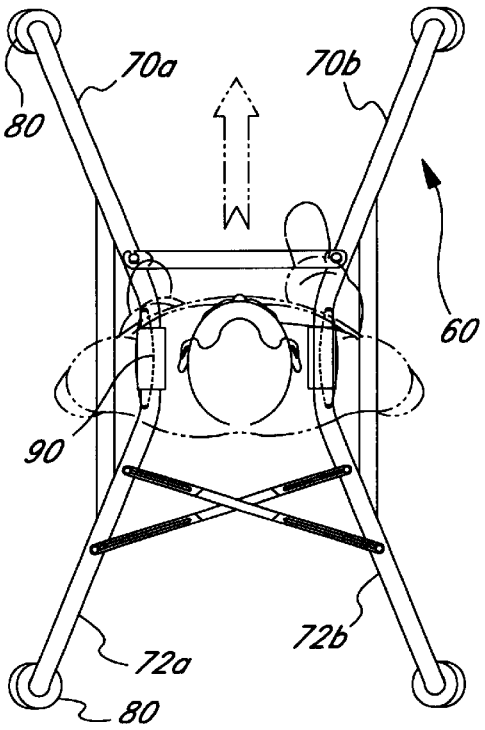
Figure 11:
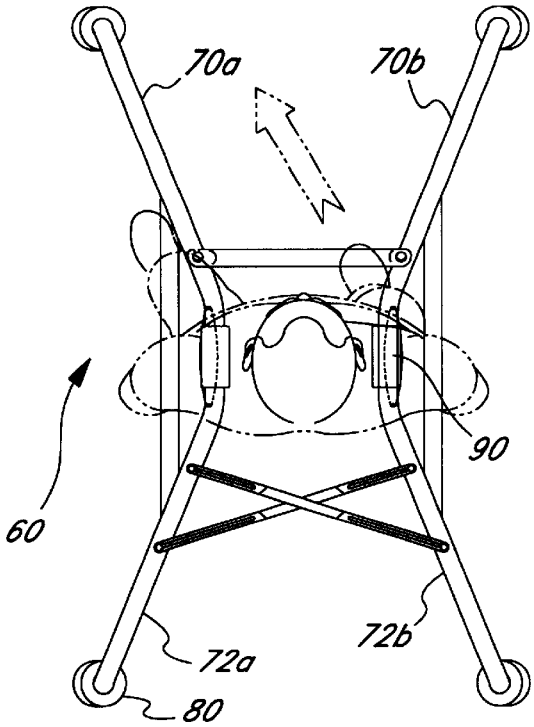
Figure 12:
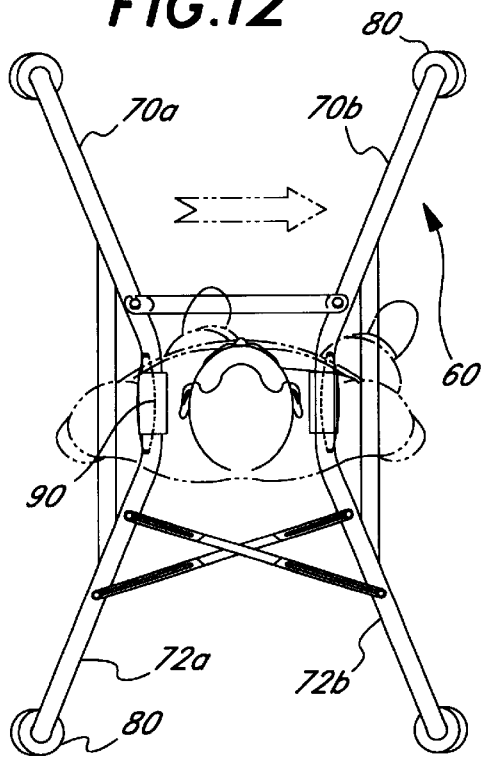
Figure 13:
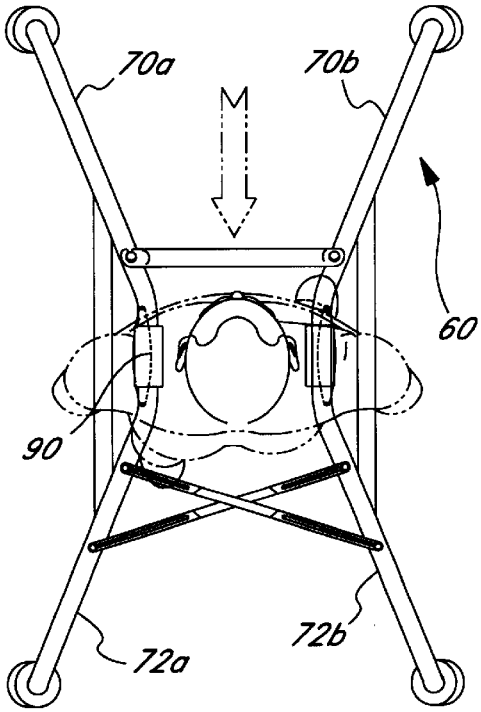

Each leg 70*a*, 70*b*, 72*a*, and 72*b* has a distal end to which is attached a ball roller assembly 200. As best shown in FIG. 9, each ball roller assembly 200 includes a ball 202 mounted between a moveable bearing race 204 and a stationary bearing race 206. The moveable bearing race 204 has disposed between individual roller bearing 207 nylon brake pads 209. The roller assemblies 200 each include a cover 208 that houses a compression spring 210 that is attached to the moveable bearing race 204. The stationary bearing race 206 is attached to the treaded end 208*a* of the cover 208.

When the spring 210 is not in compression, the nylon brake pads 209 are adjacent to the surface of the ball 202 or just touch this surface. Consequently, the ball 202 is free to rotate as long as the weight of the user does not bear down on the device 60. When the device 60 is supporting the entire weight of the user, the nylon brake pads 209 engage the surface of the ball 202, inhibiting rotation of the ball. When device 60 is not supporting the entire weight of the user, the spring 210 pulls the moveable bearing race 204 inward to disengage the nylon brake pads 209. The ball roller assembly 200 is shown used in connection with the device 60, but it could also be used with the skater safety and training device 10.

Figure 14:
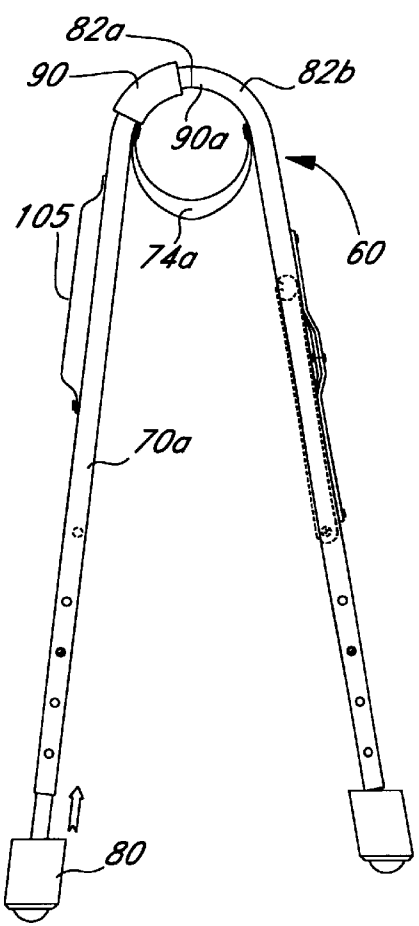

The upper segments 78 of the legs 70*a,* 70*b,* 72*a,* and 72*b* are curved so that the curved portions 82*a* and 82*b* of each aligned pair of forward legs and rear legs 70*a,* 72*a* and 70*b,* 72*b* face each other as best shown in FIGS. 6, 8A through 8D, 14, and 15. These curved portions form the mounting section 64, and the legs 70*a,* 70*b,* 72*a,* and 72*b* are all of tubular construction. A moveable sleeve 90 covers these curved portions 82*a* and 82*b* when the device 60 is in the unfolded state as depicted in FIGS. 6 and 8A. As shown in FIG. 8A, the sleeve 90 normally is in a central position that overlies the junction 90*a* between the abutting ends of the curved portions 82*a* and 82*b*. A pin 91 holds the sleeve 90 in position overlying the junction 90*a* until manually pulled from the sleeve to allow the sleeve to be moved sideways. As shown in FIGS. 8C and 14, the junction 90*a* is exposed when the sleeve 90 is moved sideways from its central position to expose the opposed and abutting proximal ends of the curved portions 82*a* and 82*b*. As shown in FIG. 8D, these opposed ends of the curved portions 82*a* and 82*b* are connected by a tongue 94 in the one end that fits into a groove 96 in the other end. To disconnect the opposed ends of the curved portions 82*a* and 82*b* the sleeve 90 is simply moved sideways and one leg 70*a*rotated to disengage a locking element 94*a* at the end of the tongue 94. The opposed ends are then pulled apart to pull the tongue 94 from the groove 96. In an alternate arrangement, the legs may be coupled together so that merely twisting the legs relative to each other enable a connecting element to act as a hinge, permitting the legs to simply be folded inward towards each other. Reposition in the legs will cause them to be locked together.

Figure 6B:
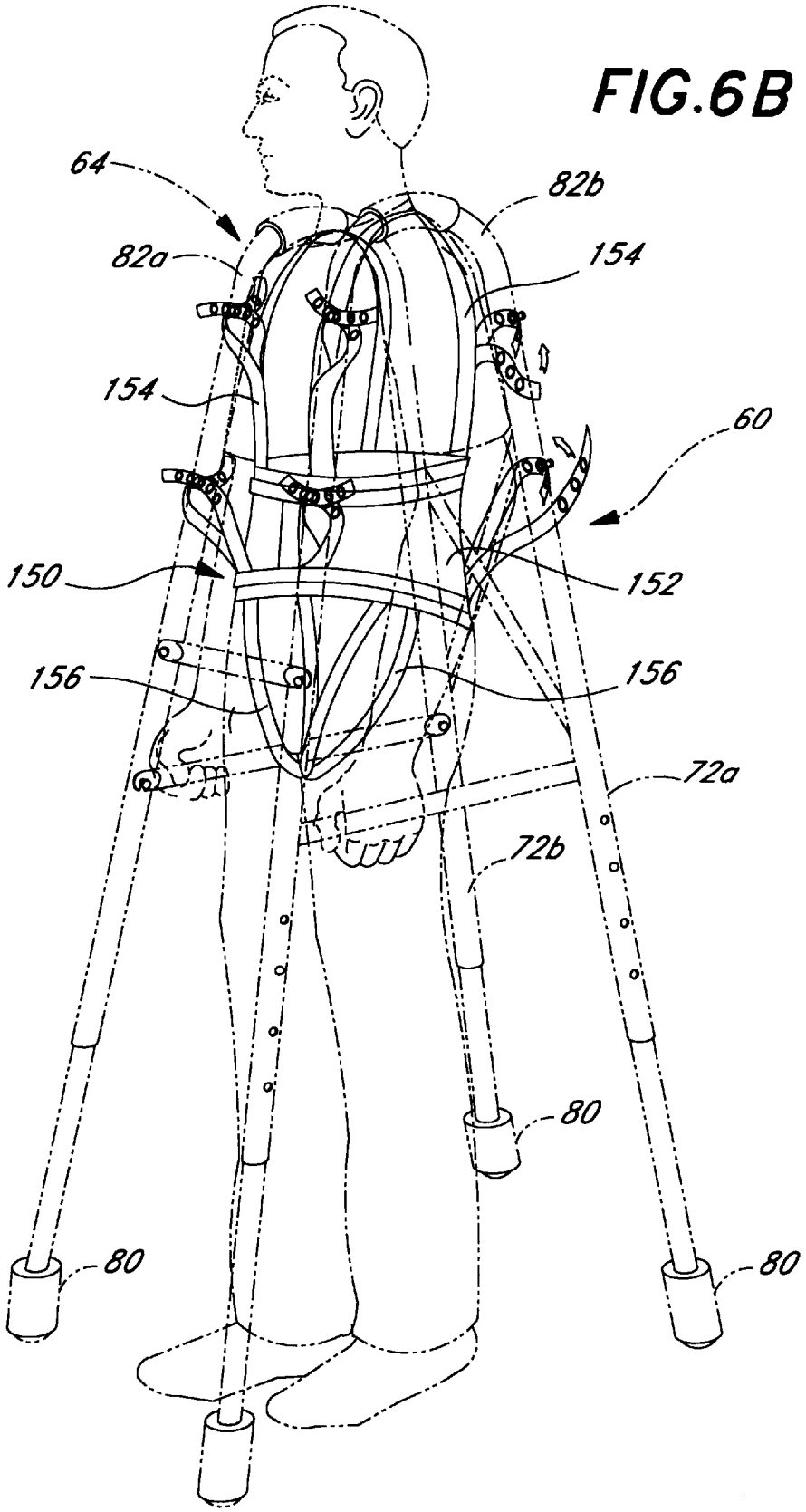
FIG. 6B is a perspective view of the walker support device depicted in FIG. 6 and shown in phantom lines showing a user in phantom lines standing erect and being strapped to the device by a harness.
Figure 6D:
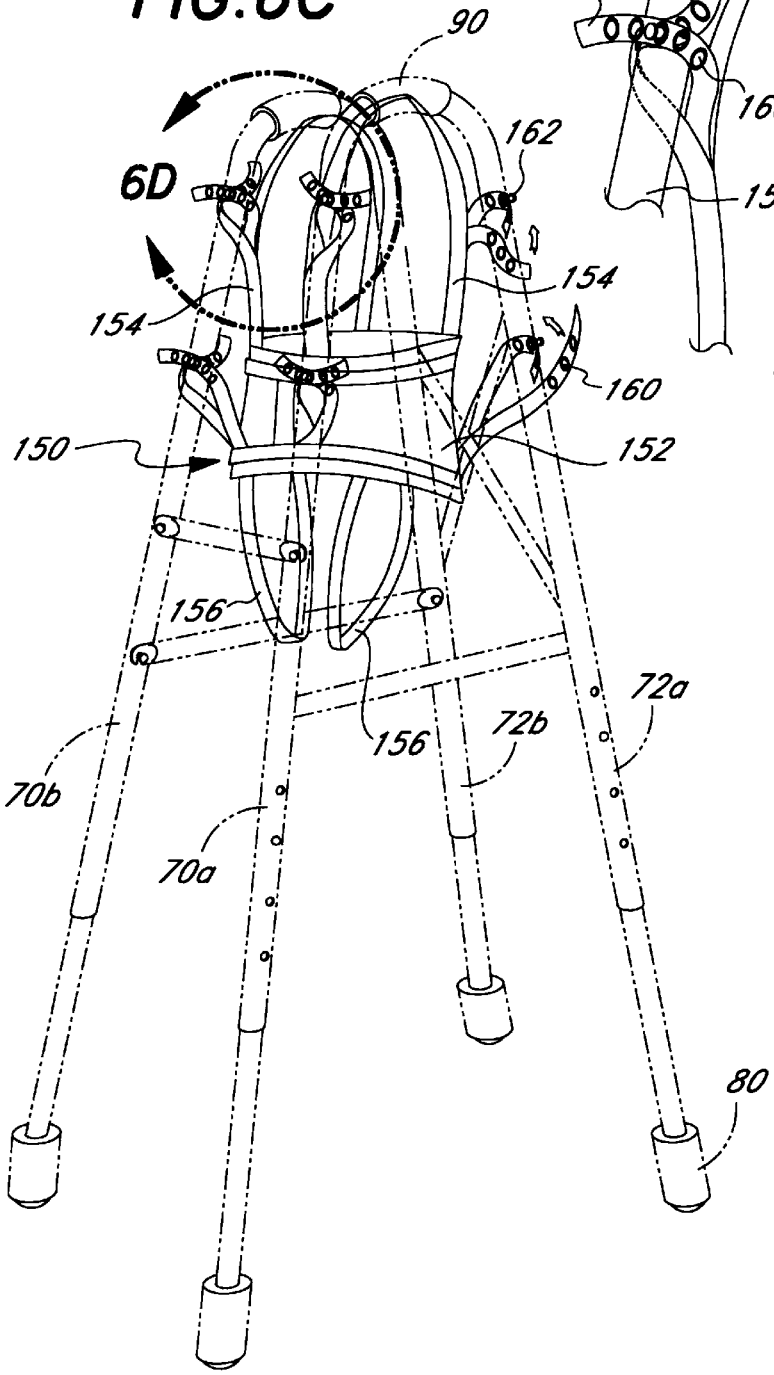
FIG. 6D is an enlarged, fragmentary perspective view taken along line 6D of FIG. 6C illustrating the manner of attaching the harness to the device.
Figure 6D:
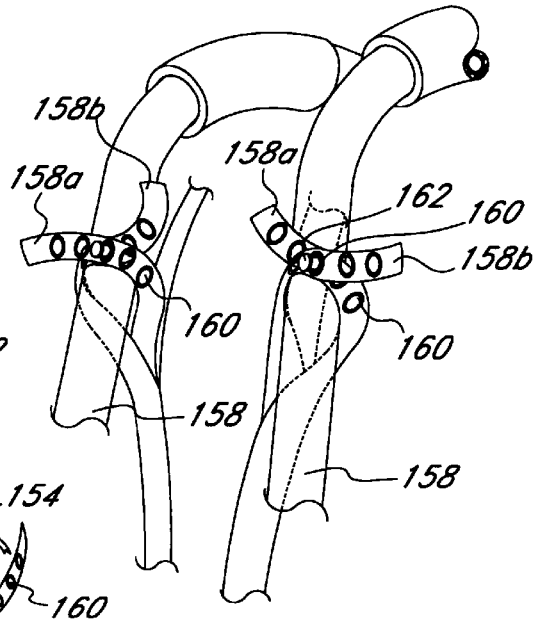

As illustrated in FIGS. 6B, 6C And 6D, the device may optionally include a harness 150. This harness 150 has a waist band 152 with shoulder straps 154 extending upward from the waist band 152 and leg straps 156 extending downward from the waist band. The lower portions of the leg straps 156 are joined together. Extending form each of the shoulder straps 154 and each of the legs straps 156 is a connector strap 158. Each connector strap 158 has two sections 158*a* and 158*b* with a series of eye opening 160 therein. Fingers 162 extending outward from the upper segment 78 of the legs 70*a,* 70*b,* 72*a,* and 72*b* fit through two overlapping sections 158*a* and 158*b*. The manner of attaching the harness to the device 60 is best illustrated in FIG. 6D. One section 158*a* is wrapped in one direction around a portion of the leg adjacent a finger 162 and the finger 162 is slipped into an eye opening 160 in section 158*a*. The other section 158*b* is then wrapped in the other direction around this same portion of the leg adjacent the finger 162, overlapping the section 158*a,* and the finger is slipped into an eye opening 160 in section 158*b*.

Figure 15:
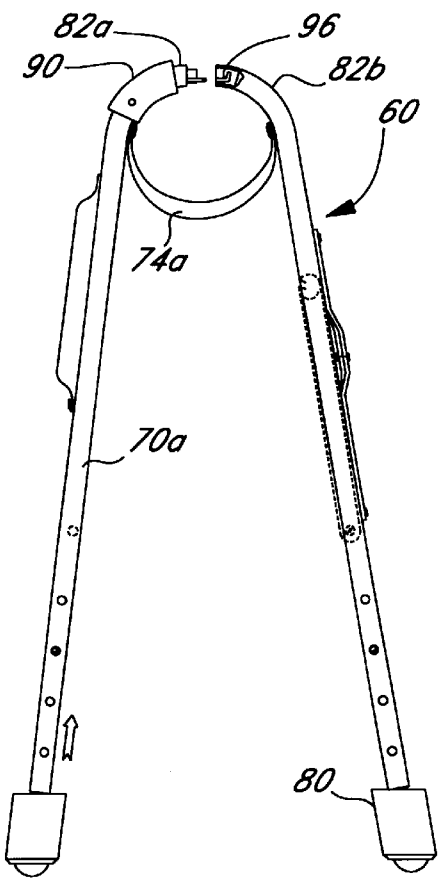
FIG. 15 is a side view of the device illustrated in FIG. 14 showing the front and rear legs detached.

As shown in FIGS. 10, 11, 12, and 13, the user may move the device in any direction. The legs 70*a,* 70*b,* 72*a,* and 72*b* diverge outward in a manner that stabilizes the device 60, so that even if the user falls, the device will still support him or her. The additional use of the harness 150 further insures the safety of the user. When the device is not being used, it is simply folded up as depicted in FIGS. 14 through 17. First, the sleeve 90 is moved from its central position sideways as shown in FIG. 15 and the opposed ends detached. Next, the front brace 105 and hand grips 100 are pushed upward to pivot and be moved into alignment with the leg to which they are pivotally attached, and the cross-bar 104 is collapsed as shown in FIGS. 16 and 17. To unfolded, these steps are reversed.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention

What is claimed is:

1. A safety support device for supporting a user's body above ground while using the device, including a frame having a mounting section with a forward end and a rear end, a pair of forward legs attached to the forward end of the mounting section and a pair of rear legs attached to the rear end of the mounting section, at least one pair of said legs each having distal ends to which is attached a roller assembly, each said roller assembly including a cover and a ball member at least partially enclosed within said cover, with each said cover having a first end attached to the distal end of the leg carrying the roller assembly and a second open end, a compression spring positioned within each cover and having a first moveable race attached thereto near said open end and a second stationary race mounted at said open end, said ball member being seated between said first and second races and said spring pulling the first moveable race inward to disengage the brake element so long as said spring is not in compression, positioning the brake element adjacent to a surface of the ball member or just touching said surface.

* * * * *